US008460060B2

(12) United States Patent
Wilson et al.

(10) Patent No.: US 8,460,060 B2
(45) Date of Patent: Jun. 11, 2013

(54) METHOD FOR CREATING A COMPLEX SURFACE ON A SUBSTRATE OF GLASS

(75) Inventors: Douglas J. Wilson, Fort Gratiot, MI (US); Paul R. Henion, Port Huron, MI (US); Brian Glombowski, Clyde Township, MI (US)

(73) Assignee: SMR Patents S.a.r.l., Luxembourg (LU)

( * ) Notice: Subject to any disclaimer, the term of this patent is extended or adjusted under 35 U.S.C. 154(b) by 467 days.

(21) Appl. No.: 12/697,348

(22) Filed: Feb. 1, 2010

(65) Prior Publication Data

US 2010/0197203 A1 Aug. 5, 2010

Related U.S. Application Data

(60) Provisional application No. 61/148,403, filed on Jan. 30, 2009.

(51) Int. Cl.
*B24B 1/00* (2006.01)

(52) U.S. Cl.
USPC ..... 451/41; 451/28; 451/42; 451/63

(58) Field of Classification Search
None
See application file for complete search history.

(56) References Cited

U.S. PATENT DOCUMENTS

| | | | | | |
|---|---|---|---|---|---|
| 869,938 | A | * | 11/1907 | Schwinzer | 65/39 |
| 1,350,441 | A | * | 8/1920 | Drescher | 65/37 |
| 2,911,177 | A | | 11/1959 | West | |
| 3,012,384 | A | * | 12/1961 | Brown et al. | 451/41 |
| 3,267,806 | A | | 8/1966 | Azegami | |
| 3,866,358 | A | * | 2/1975 | Rupp | 451/42 |
| 3,905,162 | A | * | 9/1975 | Lawrence et al. | 451/36 |
| 4,325,609 | A | | 4/1982 | Alford | |
| 4,445,300 | A | * | 5/1984 | Sekiya et al. | 451/41 |
| 4,825,596 | A | * | 5/1989 | Kinner | 451/14 |
| 4,986,035 | A | * | 1/1991 | Lambot | 451/41 |
| 5,005,962 | A | | 4/1991 | Edelman | |
| 5,022,747 | A | | 6/1991 | Polanyi et al. | |
| 5,329,735 | A | * | 7/1994 | Charlton et al. | 451/41 |
| 5,530,588 | A | | 6/1996 | Vivier | |
| 5,700,179 | A | * | 12/1997 | Hasegawa et al. | 451/41 |
| 5,938,381 | A | * | 8/1999 | Diehl et al. | 409/132 |
| 5,964,650 | A | * | 10/1999 | Born et al. | 451/63 |
| 6,032,323 | A | | 3/2000 | Smith et al. | |
| 6,116,987 | A | * | 9/2000 | Kubo | 451/41 |
| 6,199,993 | B1 | | 3/2001 | Mou | |

(Continued)

FOREIGN PATENT DOCUMENTS

| | | |
|---|---|---|
| DE | 2915521 | 10/1980 |
| DE | 3329998 | 3/1985 |

(Continued)

*Primary Examiner* — George Nguyen
(74) *Attorney, Agent, or Firm* — Reising Ethington PC

(57) ABSTRACT

A method for creating a concave section of glass from a glass substrate having flat surfaces includes the use of a grinding wheel and a turntable. The method includes the steps of securing the glass substrates to the turntable. The turntable is then spun to create a turntable axis of rotation. The grinding wheel is rotated about a wheel axis of rotation such that the wheel axis of rotation is perpendicular to the turntable axis of rotation. The grinding wheel and the turntable move relative to each other along the turntable axis of rotation. The glass substrate is ground by the grinding wheel contacting the glass substrate to create the concave section of glass while the glass substrate is rotating about the wheel axis of rotation and moving relative to the turntable.

12 Claims, 6 Drawing Sheets

U.S. PATENT DOCUMENTS

| | | | | |
|---|---|---|---|---|
| 6,276,994 | B1 * | 8/2001 | Yoshida et al. | 451/41 |
| 6,302,769 | B1 * | 10/2001 | Nishi et al. | 451/44 |
| 6,315,419 | B1 | 11/2001 | Platzer, Jr. | |
| 6,343,402 | B1 | 2/2002 | Smith et al. | |
| 6,398,377 | B1 | 6/2002 | Chou | |
| 6,522,451 | B1 | 2/2003 | Lynam | |
| 6,537,138 | B2 | 3/2003 | Ohmori et al. | |
| 6,717,712 | B2 | 4/2004 | Lynam et al. | |
| 6,932,483 | B2 | 8/2005 | Strumolo et al. | |
| 6,979,090 | B1 | 12/2005 | Wnuk | |
| 7,001,032 | B2 | 2/2006 | Lo | |
| 7,025,469 | B1 | 4/2006 | Manfre' et al. | |
| 7,097,312 | B2 | 8/2006 | Platzer, Jr. | |
| 7,104,871 | B1 * | 9/2006 | Kennedy | 451/41 |
| 7,267,448 | B2 | 9/2007 | Schmidt et al. | |
| 7,390,242 | B2 * | 6/2008 | Kim et al. | 451/285 |
| 7,524,237 | B2 * | 4/2009 | Kim et al. | 451/285 |
| 7,854,645 | B2 * | 12/2010 | Kiontke et al. | 451/5 |
| 2003/0117731 | A1 | 6/2003 | Platzer, Jr. | |
| 2004/0114260 | A1 | 6/2004 | Bartnick | |
| 2004/0257685 | A1 | 12/2004 | Minor et al. | |
| 2005/0148285 | A1 * | 7/2005 | Hosoda | 451/5 |
| 2006/0268440 | A1 | 11/2006 | Platzer, Jr. | |
| 2006/0279863 | A1 | 12/2006 | Starbuck | |
| 2007/0021036 | A1 * | 1/2007 | Kuebler et al. | 451/5 |
| 2007/0202778 | A1 * | 8/2007 | Toyoshima et al. | 451/42 |

FOREIGN PATENT DOCUMENTS

| | | |
|---|---|---|
| EP | 0551802 | 7/1993 |
| GB | 2048189 | 12/1980 |
| JP | 55076721 | 6/1980 |
| KR | 2002092059 | 12/2002 |
| TW | 424057 | 3/2001 |

* cited by examiner

FIG. 3
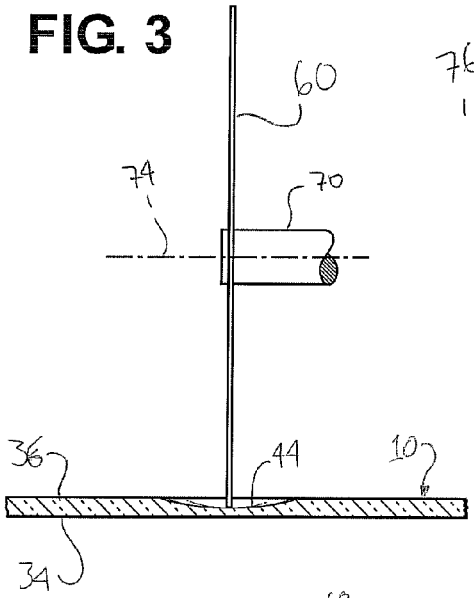
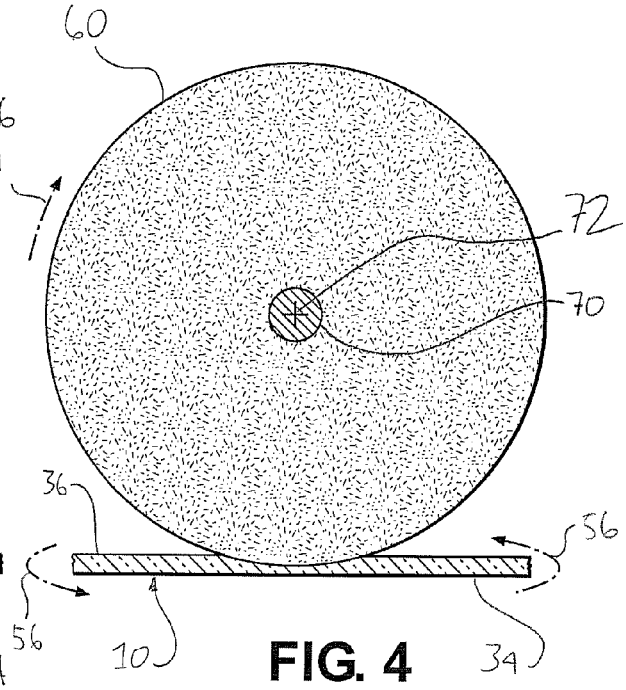
FIG. 4
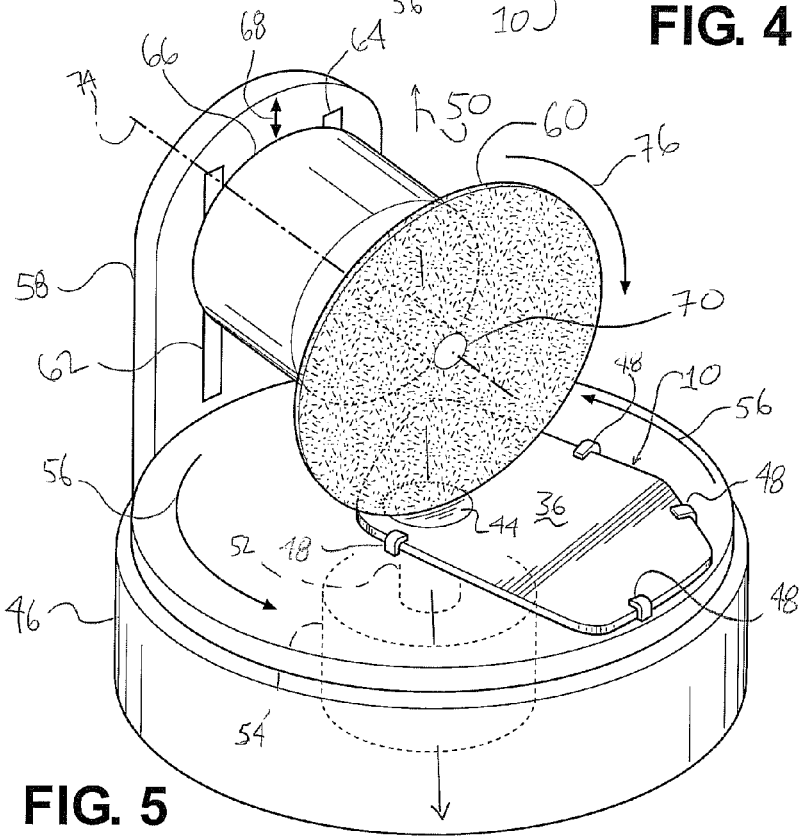
FIG. 5

METHOD FOR CREATING A COMPLEX SURFACE ON A SUBSTRATE OF GLASS

This patent application claims priority to a provisional patent application having an application No. 61/148,403, filed on Jan. 30, 2009, the specification of which is incorporated herein expressly by reference.

BACKGROUND ART

1. Field of the Invention

The invention relates to a glass substrate created to have more than one type of surface. More particularly, the invention relates to a glass substrate to be used in an external rearview mirror of a motor vehicle wherein the glass substrate used to create the mirror surface includes a primary mirror surface and a blind spot mirror surface.

2. Detailed Description of the Related Art

Blind spot mirrors are common for exterior external rearview mirrors on motor vehicles, wherein the exterior rearview mirror assembly includes a primary reflector, also known as the Main Viewing Glass, and a secondary reflector also known as a Blind Spot Mirror. Automotive manufacturers often provide these blind spot mirrors on the vehicles sold because it is well known that a "blind zone" or "blind spot" exists on the side of most vehicles.

In some instances, this secondary mirror is mounted separately from the primary reflector and thus is independently adjustable from the main viewing glass. In other cases, the secondary reflector is mounted on the same carrier, or backing plate, as the primary reflector. In still another embodiment, the blind spot mirror is a concave depression on a second surface of the primary reflector within the exterior rearview mirror. While this last concept has been well established through prior art and has been so, for some time now, this embodiment is not prevalent within the marketplace because of the extreme difficulty realized in manufacturing the concave depression in the glass substrate.

SUMMARY OF THE INVENTION

A method for creating a concave section of glass from a glass substrate having flat surfaces includes the use of a grinding wheel and a turntable. The method includes the steps of securing the glass substrates to the turntable. The turntable is then spun to create a turntable axis of rotation. The grinding wheel is rotated about a wheel axis of rotation such that the wheel axis of rotation is perpendicular to the turntable axis of rotation. The grinding wheel and the turntable move relative to each other along the turntable axis of rotation. The glass substrate is ground by the grinding wheel contacting the glass substrate to create the concave section of glass while the glass substrate is rotating about the wheel axis of rotation and moving relative to the turntable.

BRIEF DESCRIPTION OF THE DRAWINGS

Advantages of the invention will be readily appreciated as the same becomes better understood by reference to the following detailed description when considered in connection with the accompanying drawings, wherein:

FIG. 3 is an end view of a grinding wheel used by the inventive method and a cross-section of a substrate of glass;

FIG. 4 is a side view of the grinding wheel as it grinds the glass substrate;

FIG. 5 is a perspective view of the grinding wheel and the glass substrate fixedly secured to a turntable;

DETAILED DESCRIPTION OF THE PREFERRED EMBODIMENTS

Figure 1:
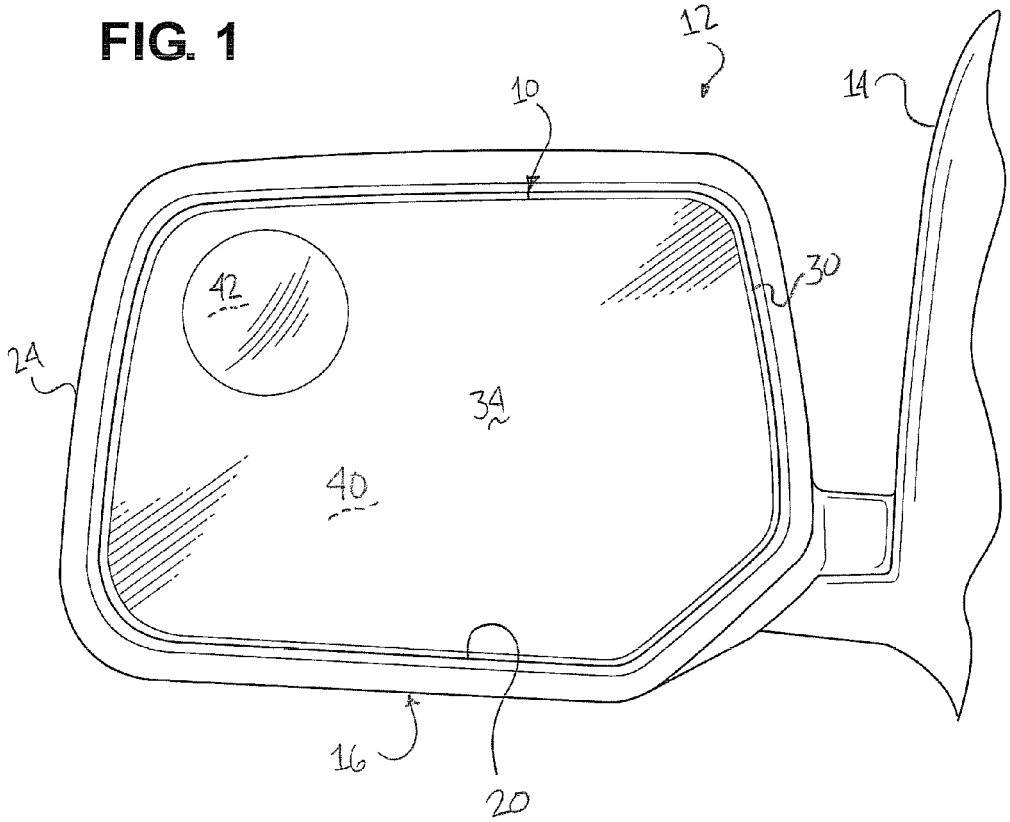
FIG. 1 is a side view of an exterior rearview mirror for a motor vehicle incorporating a glass substrate manufactured using the inventive method.
Figure 2:
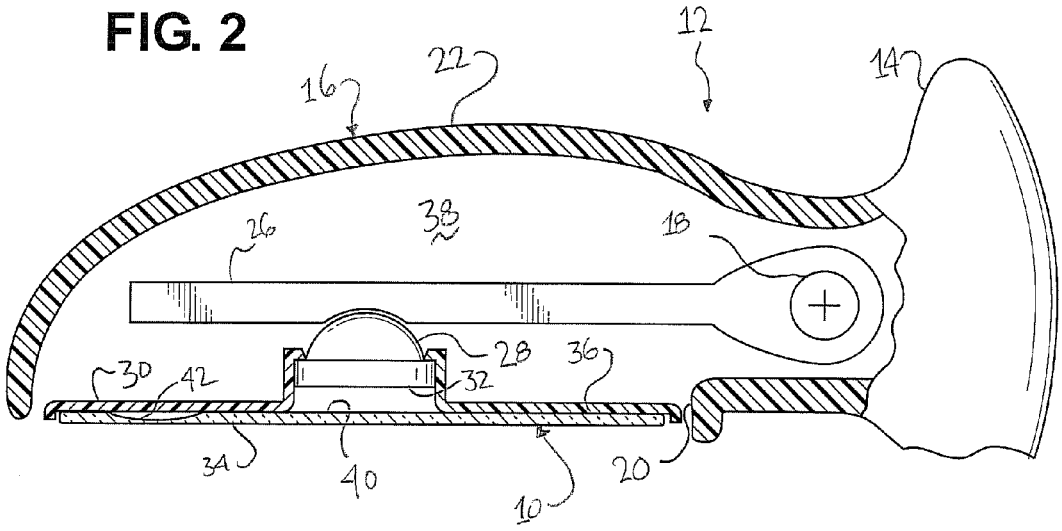
FIG. 2 is a partial cross-sectional top view of the exterior rearview mirror shown in FIG. 1.

The invention is a method for creating a glass substrate 10 having at least one surface which is complex. The glass substrate 10 is to be used in an exterior rearview mirror assembly, as is generally indicated at 12 in FIGS. 1 and 2. The exterior rearview mirror assembly 12 includes a mounting bracket 14, shown partially cutaway in the Figures which fixedly secures the exterior rearview mirror assembly 12 to a motor vehicle (not shown). A mirror case or housing, generally indicated at 16, is secured to the mounting bracket 14. In the embodiment shown, a pivot, graphically represented at 18, allows the mirror case 16 to pivot with respect to the mounting bracket 14. The mirror case 16 defines a primary opening 20 that faces rearward with respect to the forward motion of the motor vehicle. The mirror case 16 includes a forward face 22 that wraps around the primary opening 20 to create a mirror frame 24 disposed around the primary opening 20. The glass substrate 10 that creates the mirror glass is visible through the primary opening 20. It should be appreciated by those skilled in the art that the exterior rearview mirror assembly 12 may include fewer or more features, depending on the design and package choices and those features do not add or detract from the inventive method.

Extending out from the pivot 18 and into the mirror case 16 is a support structure 26. The support structure 26 is fixedly secured to the mirror case 16. In many instances, the support structure 26 may be integral with the mirror case 16. A motor 28 is secured to the support structure 26. The motor 28 is electrically connected to remote switching mechanisms in the passenger compartment to receive control signals from the driver of the motor vehicle to adjust the orientation of the glass substrate 10 with respect to the position of the driver. The electrical connections between the motor 28, the remote switching, and power are not shown but are well known to those skilled in the art.

A backing plate 30 is fixedly secured to a movable portion of a motor housing 32 that moves with respect to the rest of the motor 28 and the support structure 26. More specifically, the motor 28 moves the portion of the housing 32 based on the control signals it receives. The backing plate 30 is secured to the portion of the housing 32 that moves such that there is no lost motion therebetween. The backing plate 30 is used to secure the glass substrate 10 to the motor 28 and hold the glass substrate 10 in the desired orientation.

The glass substrate 10 is secured to the backing plate 30 with an adhesive (not shown). The glass substrate 10 includes a first surface 34 and a second surface 36. In the embodiment shown, the first surface 34 is planar and transparent. The second surface 36 is substantially planar and parallel to the first surface 34. The second surface 36 includes a reflective coating (not shown) that is applied to the glass substrate 10 prior to the adhesive being applied between the backing plate 30 and the second surface 36. The reflective coating allows the driver of the motor vehicle to see objects rearward of the exterior rearview mirror assembly 12 without having to see the backing plate 30 or the interior 38 of the mirror case 16 and all that it contains.

The second surface 36 of the glass substrate 10 is complex in that it has more than one type of viewing surface. More specifically, the second surface 36 includes a primary reflective surface 40 and a secondary reflective surface 42. The primary reflective surface 40 is planar and parallel to the first surface 34 of the glass substrate 10. The secondary reflective surface 42 is convex and smaller than the primary reflective surface 40. The secondary reflective surface 42 is commonly referred to as a blind spot or blind zone mirror. While the secondary reflective surface 42 may be located anywhere with respect to the primary reflective surface 40, it is shown in the upper left hand corner of the glass substrate 10 as viewed by the driver of the motor vehicle. The secondary reflective surface 42 is created prior to the coating of the second surface 36 with reflective coating. Therefore, it has the same reflective qualities as the primary reflective surface 40.

Once the concave surface 44 has been created, the concave surface 44 is polished. The polishing of the concave surface 44 may include a very fine grit abrasive material. In addition, the step of polishing may include a slurry that may include cerium oxide. The step of polishing may occur before or after the step of removing the glass substrate 10 from the turntable 46.

Referring to FIGS. 3 through 14, graphic representations of various preferred embodiments of the inventive method are depicted, wherein similar elements used in the various preferred embodiments of the inventive method are indicated by reference numerals offset from one another by factors of 100. Referring specifically to FIGS. 3 through 5, one embodiment of an inventive method is graphically represented. The method used for creating a concave surface 44 in the glass substrate 10 is shown. The concave surface will be used to create the secondary reflective surface 42 once the reflective coating is applied to the second surface of the glass substrate 10. At this point in the preparation of the glass substrate 10, there is no reflective coating applied to the second surface 36. The concave surface 44 is created out of the second surface 36 of the glass substrate 10. In all of the embodiments discussed herein, the glass substrate 10 will include a first surface 36 and a second surface 36 that are planar and parallel to each other. The concave surface 44 is the only portion of the glass substrate 10 that deviates from the flat first 34 and second 36 surfaces.

To create the concave surface 44, the glass substrate 10 is secured to a turntable 46. Hooks 48 are used to secure the glass substrate 10 to the turntable 46. Devices similar to hooks 48 may be used. In addition, a vacuum may be applied to the glass substrate 10 from the turntable 46 to secure the glass substrate 10 thereto. The turntable 46 is spun to create a turntable axis of rotation 50. As shown in FIG. 5, the axis of rotation is defined by an output shaft 52 of a motor 54, both shown in phantom. It may be appreciated by those skilled in the art that the turntable axis of rotation 50 may be separate and distinct from the axis of rotation for the output shaft 52 and that the turntable 46 may be belt driven or driven through some other linkage that does not directly connect the motor 54 to the output shaft 52. Arrows 56 graphically represent the rotation of the turntable 56 and, therefore, the glass substrate 10. The turntable spins about the turntable axis of rotation 50 in a range between four revolutions per minute (rpm) and 100 rpm. In this embodiment, it is contemplated that the turntable 46 spins at approximately 20 rpm.

Disposed adjacent the turntable is a pillar 58. The pillar 58 is stationary with respect to the turntable 46. The pillar 58 represents a stationary structure from which a grinding wheel 60 will move in relation thereto. It should be appreciated by those skilled in the art that the pillar 58 may be replaced with another structure that provides a support for the movement of the grinding wheel 60 with respect to the turntable 46. By way of example, the pillar 58 may be replaced with a base located remote from the turntable 46, whereby a robot arm would extend from the base to position the grinding wheel 60 in the appropriate position with respect to the turntable 46.

The pillar 58 includes two channels 62, 64 through which a grinding wheel motor 66 is secured. The channels 62, 64 provide the grinding wheel 66 with the ability to move up and down, as represented by arrow 68 (the directions up and down are used for purposes of the relationships shown in the Figures and are not to be interpreted as limiting). The grinding wheel 60 also moves up and down in the directions defined by arrow 68. The grinding wheel 60 moves, however, along the turntable axis of rotation 50 such that when it is moved far enough, it engages the glass substrate 10 at a point where the turntable axis of rotation 50 intersects the glass substrate 10. The grinding wheel motor 66 includes an output shaft 70 that is fixedly secured to the center 72 of the grinding wheel 60. Therefore, the grinding wheel 60 rotates about an axis 74 that is defined by the output shaft 70 of the grinding wheel motor 66. As it may be appreciated by those skilled in the art, the grinding wheel 60 may be indirectly driven by the grinding wheel motor 66.

The grinding wheel motor 66 spins the grinding wheel 60 in a direction represented by arrows 76. The grinding wheel is spun at speeds in a range between 3,000 rpm and 5,000 rpm. In the preferred embodiment, the grinding wheel 60 is spun at a rate of 4,000 rpm.

Once the turntable 46 and the grinding wheel 60 are spinning at their appropriate speeds, the grinding wheel 60 is moved downwardly, the grinding wheel 60 engages the glass substrate 10. The spinning motions of the grinding wheel 60 and the turntable 46 allow the grinding wheel 60 to grind a concave surface 44 out of the second surface 36 of the glass substrate 10. In this way, the grinding wheel 60, having a defined radius, produces a concave section of glass having a concave surface 44 with a radius of curvature equal to the radius of the grinding wheel 60.

Figure 6:
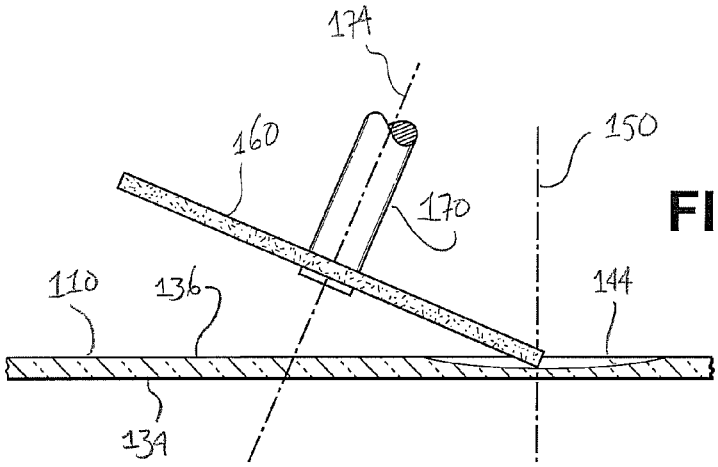
FIG. 6 is an end view of a grinding wheel used in an alternative embodiment of the invention.
Figure 7:
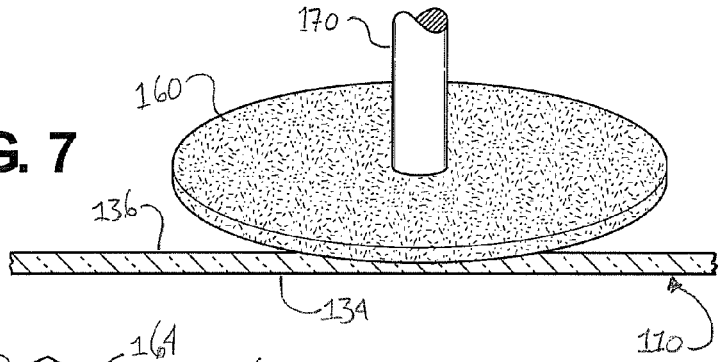
FIG. 7 is a side view of the grinding wheel used in an alternative embodiment of the invention.
Figure 8:
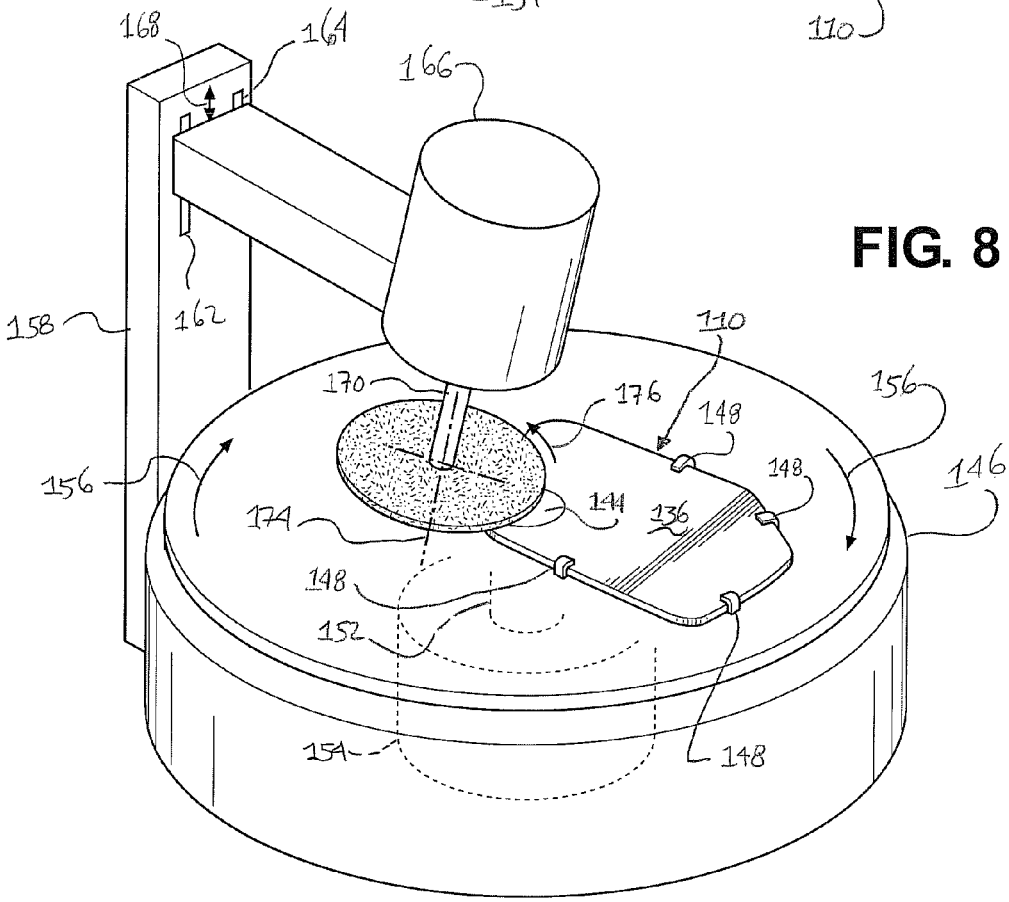
FIG. 8 is a perspective view of the grinding wheel and the turntable used in the alternative embodiment of the invention.

Referring now to FIGS. 6 through 8, wherein elements similar to those described above are offset by 100, the glass substrate 110 is having a concave surface 144 ground out thereof using a grinding wheel 160. The difference with this method when compared to the method described when referencing FIGS. 3 through 5 is that the grinding wheel 160 is no longer perpendicular to the glass substrate 110. In the prior embodiment, the axis of grinding wheel rotation 74 was parallel to the glass substrate 10. In this embodiment, the axis of grinding wheel rotation 174 is disposed at an angle other than parallel with the glass substrate 110. And while the grinding wheel 160 engages the glass substrate 110 at the turntable axis of rotation 150, the grinding wheel 160 does not extend through the turntable axis of rotation 150. The angle created between the turntable axis of rotation 150 and the axis of grinding wheel rotation 174 is at an acute angle.

The grinding wheel 160 and the turntable 146 rotate at speeds comparable to those described above. The advantage of using the grinding wheel 160 at an acute angle with respect to the turntable axis of rotation 150 is that the grinding wheel 160 may have a radius that is smaller than the resulting radius of curvature of the concave surface 144 being created by the grinding wheel 160. By way of example, the radius of the grinding wheel 160 may be in the range of $2/5^{th}$ the size of the radius of curvature of the resulting concave surface 144. In this embodiment the grinding wheel 160 moves up and down as represented by arrow 168 in a manner similar to that of the embodiment discussed above.

Figure 9:
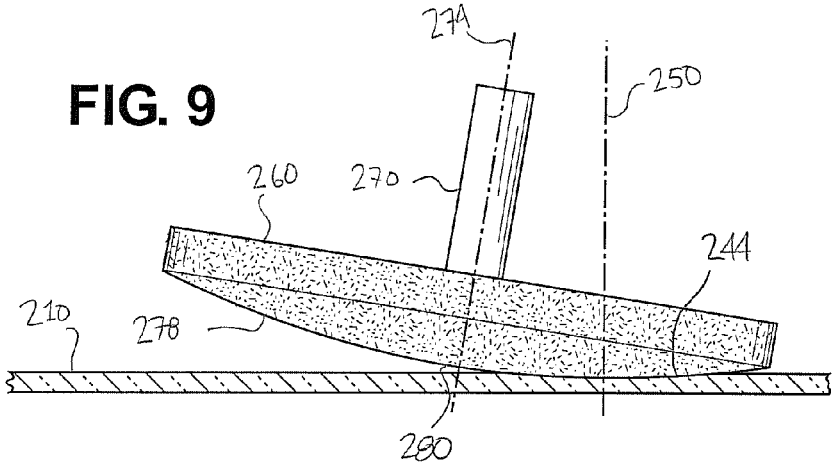
FIG. 9 is an alternative embodiment of a grinding wheel used in the second embodiment of the inventive method.
Figure 10:
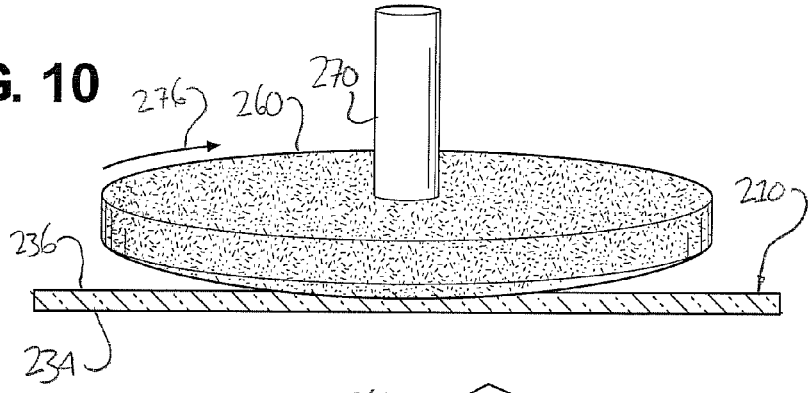
FIG. 10 is an end view of the alternative grinding wheel used in the in second alternative embodiment.
Figure 11:
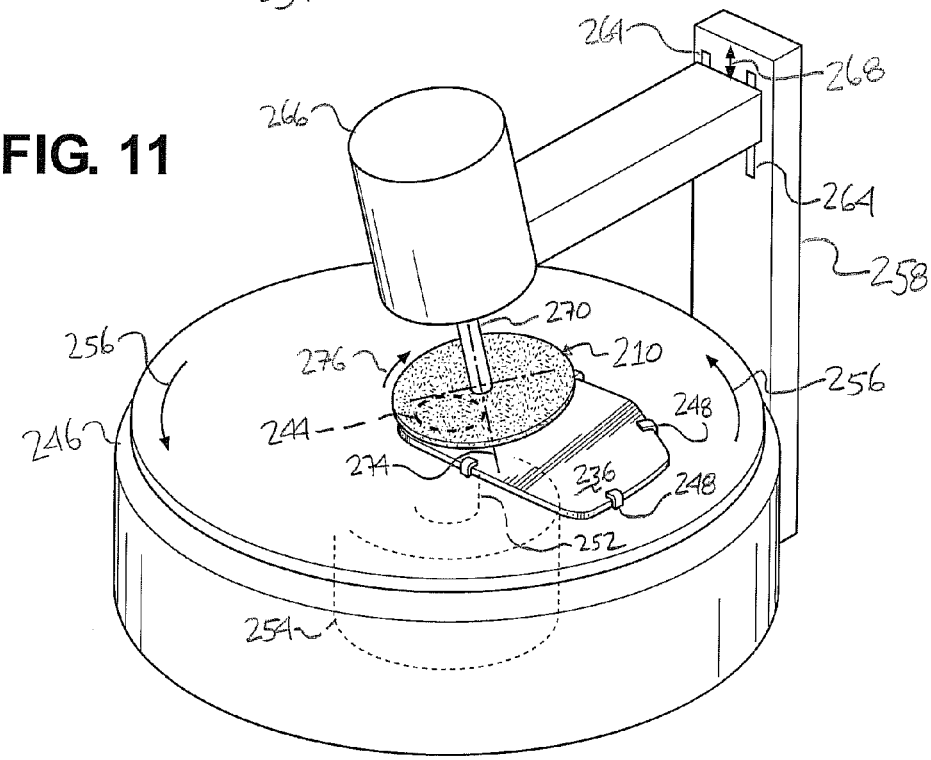
FIG. 11 is a perspective view of the alternative grinding wheel used in the alternative embodiment of the invention and the turntable associated therewith.

Referring specifically to FIGS. 9 through 11, a second alternative embodiment is shown, wherein like elements are offset from the first preferred embodiment by 200. These Figures represent an embodiment similar to those found in FIGS. 6 through 8 wherein the output shaft 270 for the grinding wheel 260 defines an axis of grinding wheel rotation 274 which is not perpendicular to the turntable axis of rotation 250. The angle defined between the axis of grinding wheel rotation 274 and the turntable axis of rotation 250 is at an acute angle similar to that described for FIGS. 6 through 8. The primary difference between the first alternative embodiment and the second alternative embodiment is that the grinding wheel 260 includes a convex surface 278 resulting in the grinding wheel 260 and output shaft 270 having a profile similar to that of a mushroom. The grinding wheel 260 and the turntable 246 rotate at rotational speeds similar to those described above. The axis of grinding wheel rotation 274 is required to define an angle with respect to the turntable axis of rotation 250 such that a central portion 280 of the convex surface 278 does not engage, abut, or contact the glass substrate 210 while the grinding wheel 260 is grinding the concave surface 244 from the glass substrate 210. Having the central portion 280 in contact with the glass substrate 210 through the grinding process will compromise the composition of the glass substrate 210 to the point where the glass substrate 210 is not useable and/or destroyed by applying increased pressure at the central portion 280 due to the reduced glass removal which would result from the slower grinding feed rate at that location 280.

Figure 12:
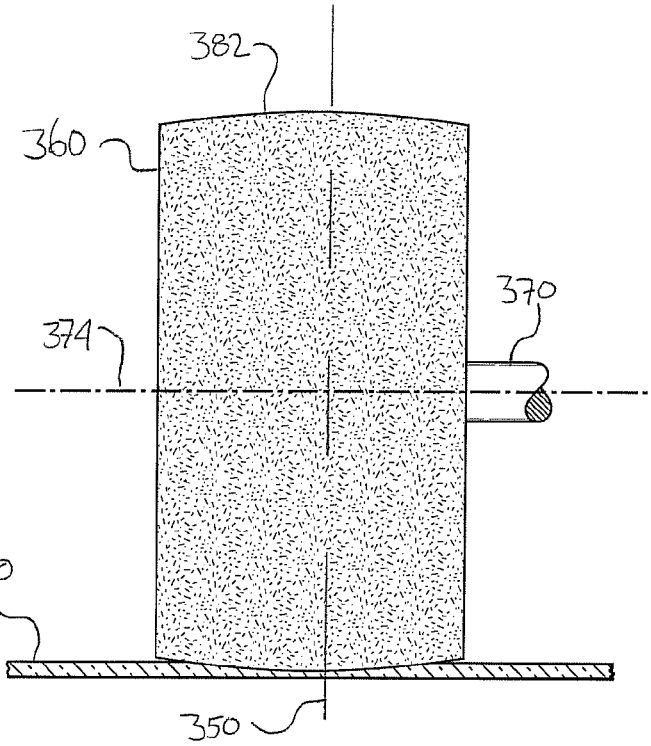
FIG. 12 is a third embodiment of the grinding wheel used according to the first embodiment of the inventive method.
Figure 13:
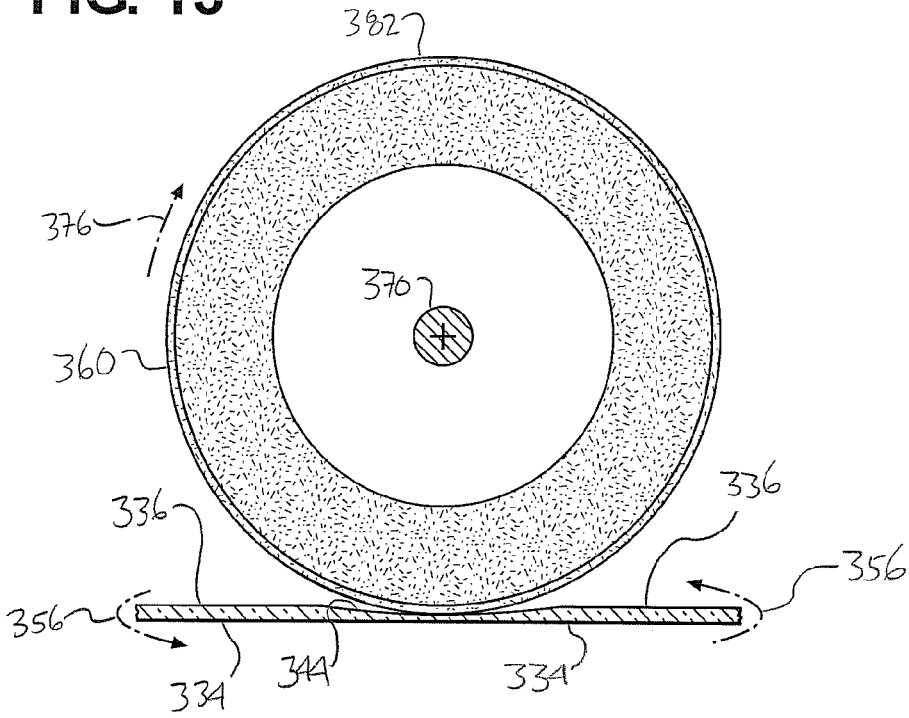
FIG. 13 is a side view of the third grinding wheel disposed adjacent the glass substrate.
Figure 14:
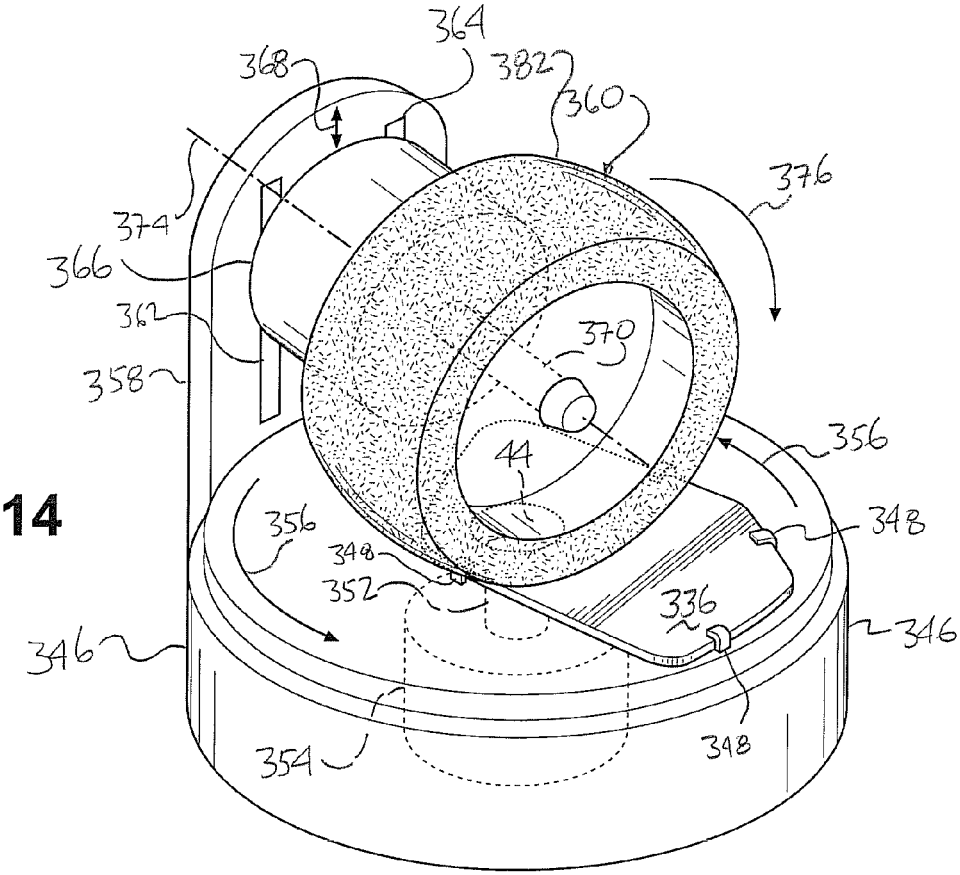
FIG. 14 is a perspective view of the third grinding wheel used according to the first inventive method.

Referring to specifically to FIGS. 12 through 14, elements similar to those described in the first preferred embodiment are offset by 300. In this embodiment, the output shaft 370 of the grinding wheel 360 is parallel to the glass substrate 310, and as such, perpendicular to the turntable axis of rotation 350. And again, the glass substrate 310 is rotated about a turntable 346 while the grinding wheel 360 is rotated about the output shaft 370.

In this embodiment, the grinding wheel 360 includes a convex outer edge 382. In addition, the grinding wheel 360 has a profile wider than that of the grinding wheel 60 shown in the preferred embodiment (FIGS. 3 through 5). The wider grinding wheel 360 with the convex surface 378 provides for a faster cycle time.

Figure 15:
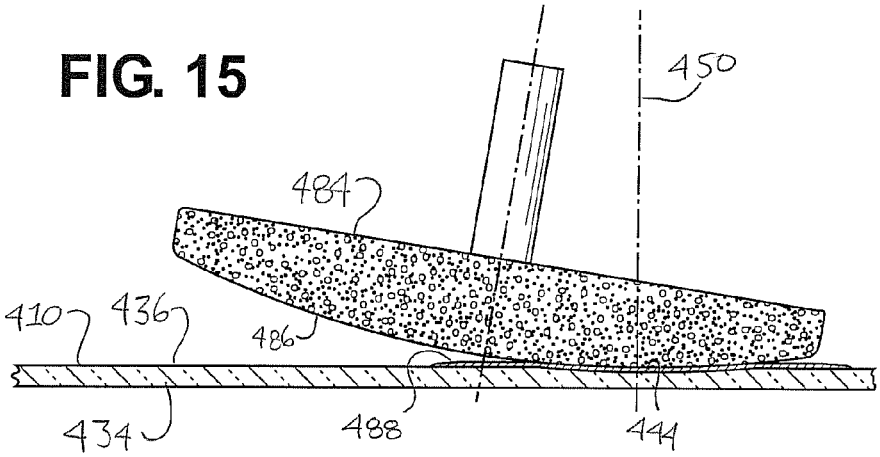
FIG. 15 is a side view of a polishing wheel used in a method for polishing a concave surface on a glass substrate.

Referring to FIG. 15, a method of polishing a concave section 444 includes the use of a polishing wheel 484 having a convex polishing pad 486 that complements the concave section 444 of the glass substrate 410. A slurry of cerium oxide 488 is applied to the glass substrate 410. The polishing wheel 484 is lowered to the concave section 444 and it is polished. Any convex polishing pad 486 suitable for polishing glass may be used. In the preferred embodiment of the polishing method, a polishing pad offered by Spartan Felt Company under the trademark DuroTex™ is used. Once the convex surface 486 is polished, it is cleaned and prepared to be coated with a reflective coating.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

We claim:

1. A method for creating a concave section of glass from a glass substrate having flat surfaces, the method comprising the steps of: securing the glass substrate to a turntable; spinning the turntable to create a turntable axis of rotation; positioning a grinding wheel over the turntable and the glass substrate such that the grinding wheel contacts the glass substrate at the turntable axis of rotation; rotating the grinding wheel about a wheel axis of rotation such that the wheel axis of rotation defines an angle less than ninety degrees with respect to the turntable axis of rotation; moving the grinding wheel and the turntable relative to each other; and grinding a concave section of glass from the glass substrate while said grinding wheel is rotating about the wheel axis of rotation and moving relative to the turntable.

2. A method as set forth in claim 1 including the step of positioning the glass substrate on the turntable such that the turntable axis of rotation extends through the glass substrate prior to the step of securing the glass substrate.

3. A method as set forth in claim 2 wherein the step of spinning the turntable includes spinning the turntable in a range between 4 and 100 rpm.

4. A method as set forth in claim 3 wherein the step of rotating the grinding wheel includes rotating the grinding wheel in a range between 3,000 rpm and 5,000 rpm.

5. A method as set forth in claim 4 wherein the step of moving the grinding wheel and the turntable relative to each other includes the step of moving the grinding wheel along a wheel travel axis spaced apart from and parallel to the turntable axis of rotation.

6. A method as set forth in claim 4 wherein the step of moving the grinding wheel and the turntable relative to each other includes the step of moving the turntable about the turntable axis of rotation.

7. A method as set forth in claim 1 wherein the grinding wheel includes a convex surface.

8. A method as set forth in claim 7 wherein the step of grinding includes the step of grinding the glass substrate using the convex surface of the grinding wheel.

9. A method as set forth in claim 8 including the step of positioning the glass substrate on the turntable such that the turntable axis of rotation extends through the glass substrate prior to the step of securing the glass substrate.

10. A method as set forth in claim 9 wherein the step of spinning the turntable includes spinning the turntable in a range between 4 and 100 rpm.

11. A method as set forth in claim 10 wherein the step of rotating the grinding wheel includes rotating the grinding wheel in a range between 3,000 rpm and 5,000 rpm.

12. A method as set forth in claim 1 including the step of polishing the concave section of glass after the step of grinding.

* * * * *